US009975693B2

(12) United States Patent
King et al.

(10) Patent No.: US 9,975,693 B2
(45) Date of Patent: May 22, 2018

(54) WELDED FULL CONTACT FLOATING ROOF AND METHOD

(71) Applicant: HMT, LLC, The Woodlands, TX (US)

(72) Inventors: Richard Paul King, Magnolia, TX (US); Michael Joseph Kaminski, Cypress, TX (US)

(73) Assignee: HMT, LLC, The Woodlands, TX (US)

( * ) Notice: Subject to any disclaimer, the term of this patent is extended or adjusted under 35 U.S.C. 154(b) by 45 days.

(21) Appl. No.: 14/799,320

(22) Filed: Jul. 14, 2015

(65) Prior Publication Data

US 2017/0015495 A1 Jan. 19, 2017

(51) Int. Cl.
*B65D 88/34* (2006.01)

(52) U.S. Cl.
CPC ..... *B65D 88/34* (2013.01)

(58) Field of Classification Search
CPC ..... B65D 88/34; B65D 88/46; B65D 90/42; B65D 81/245
USPC ..... 220/216, 218
See application file for complete search history.

(56) References Cited

U.S. PATENT DOCUMENTS 289,557 A * 12/1883 Reinecke ..... B65D 88/34 160/231.1
2,007,193 A * 7/1935 Griffin ..... B65D 88/34 220/218
2,867,346 A * 1/1959 Champagnat ..... B65D 88/34 220/217
2,867,347 A * 1/1959 Champagnat ..... B65D 88/34 220/216
2,913,138 A * 11/1959 Swick ..... B65D 88/34 137/247
3,374,918 A * 3/1968 Creith ..... B65D 88/34 220/216
3,774,799 A * 11/1973 Heisterberg ..... B65D 88/34 220/216
4,202,460 A * 5/1980 Imbeault ..... B65D 88/36 220/218
6,193,092 B1 * 2/2001 Witter ..... B65D 88/36 220/218
6,922,956 B2 * 8/2005 Johnson ..... B65D 88/34 220/216
8,973,771 B2 3/2015 Doxey et al.
2009/0223957 A1 * 9/2009 Doxey ..... B65D 88/34 220/216
2015/0175349 A1 6/2015 Doxey et al.

* cited by examiner

*Primary Examiner* — Anthony Stashick
*Assistant Examiner* — James Way
(74) *Attorney, Agent, or Firm* — Fletcher Yoder, P.C.

(57) ABSTRACT

A roof panel of a sealed floating roof for a storage tank includes a first frame segment and a second frame segment. Each of the first and second frame segments includes a first depression configured to abut an adjacent top depression of a respective frame segment of a respective adjacent roof panel to form a walled trough to guide an automatic welder along a weld joint during a welding process. The roof panel also includes a panel component. The panel component includes a top sheet and a pan-shaped bottom sheet coupled to the top sheet. The pan-shaped bottom sheet is coupled to a respective upper lip of each of the first and second frame segments.

19 Claims, 10 Drawing Sheets

WELDED FULL CONTACT FLOATING ROOF AND METHOD

BACKGROUND

The present disclosure pertains to sealed floating roofs for storage tanks.

Above ground storage tanks are frequently used to store hydrocarbon fluids. Because the stored fluid (e.g., liquid, gas, liquid-gas mixtures) may be volatile, the storage tank is often equipped with a floating roof. Some storage tanks utilize a combination fixed roof and floating roof design. The floating roof may be a full-contact floating roof configured to move up and down with the fluid level in the tank. In other words, the floating roof makes contact with the fluid within the tank. As a result, air gaps between the roof and the fluid may be reduced, thereby reducing fluid evaporation and potentially decreasing losses of stored product.

Storage tanks may be designed with seals to prevent leakages or losses of product. For example, the storage tanks may be formed from roof panels that are bolted and/or riveted to an internal frame. Additionally, the roof panels may include sealing devices (e.g., polymers, metals, composite materials) to substantially isolate the environment from the interior of the tank. However, under certain conditions, the seals may degrade over time, thereby resulting in repairs and/or potential leakage points.

In order to reduce the likelihood of leakages, some storage tanks include welded connections between the roof panels. On such design, presented in U.S. patent application Ser. No. 12/642,270, which is hereby incorporated by reference, includes a roof panel having a sealed cavity. In such embodiments, a weld seam coupling a bottom plate to a frame member may be exposed to product within the tank. However, it may be desirable to provide a floating roof having weld seams that are substantially isolated from the product within the tank.

SUMMARY

In an embodiment, a roof panel of a sealed floating roof for a storage tank includes a first frame segment and a second frame segment. Each of the first and second frame segments includes a first depression configured to abut an adjacent top depression of a respective frame segment of a respective adjacent roof panel to form a walled trough to guide an automatic welder along a weld joint during a welding process. The roof panel also includes a panel component. The panel component includes a top sheet and a pan-shaped bottom sheet coupled to the top sheet. The pan-shaped bottom sheet is coupled to a respective upper lip of each of the first and second frame segments.

In a further embodiment, a sealed floating roof for a storage tank includes a plurality of roof panels positioned adjacent to one another. Each of the plurality of roof panels includes a first frame segment, a second frame segment, and a panel component. The panel component includes a pan and a top sheet coupled to the pan. The pan is coupled to a respective upper lip of each of the first and second frame segments.

In another embodiment, a roof panel of a sealed floating roof for a storage tank includes a first frame segment comprising a first upper lip and a first lower frame extension. The roof panel also includes a second frame segment comprising a second upper lip and a second lower frame extension. Moreover, the roof panel includes a panel component coupled to the first and second upper lips. The panel component includes a top sheet and a pan positioned beneath and coupled to the top sheet. The pan is exposed to an interior of the storage tank, and the top sheet is isolated from the interior of the storage tank.

DETAILED DESCRIPTION OF THE DISCLOSURE

Embodiments of the present disclosure are directed toward a roof panel for use with a floating roof for a storage tank. Specifically, multiple roof panels may be used to form the floating roof. In certain embodiments, the floating roof is a full-contact floating roof configured to contact a fluid (e.g., a liquid, a gas, a liquid-gas mixture) within the storage tank, thereby substantially reducing and/or eliminating evaporation within the tank. The roof panel may include a panel component coupled to at least one frame member. In certain embodiments, roof panels are substantially square or rectangular. However, in other embodiments, roof panels may include curved edges that correspond to a perimeter of the storage tank. The roof panels may be configured to substantially isolate pressure-containing welds from the fluid within the storage tank. For example, the panel component may be welded to the frame on an outside (e.g., top side, exterior) surface of the storage tank and/or the floating roof. As a result, the weld may not be exposed to the fluid within the storage tank, thereby potentially increasing the useful life of the weld and/or reducing the likelihood of leakage from the tank. The roof panels may be assembled off-site and tested (e.g., pressure tested, dye-penetrant tested, etc.) before assembly on site. At the work site, the roof panels may be coupled to one another (e.g., welded) via an automatic welder, thereby improving assembly efficiencies and repeatability of the welds.

Figure 1:
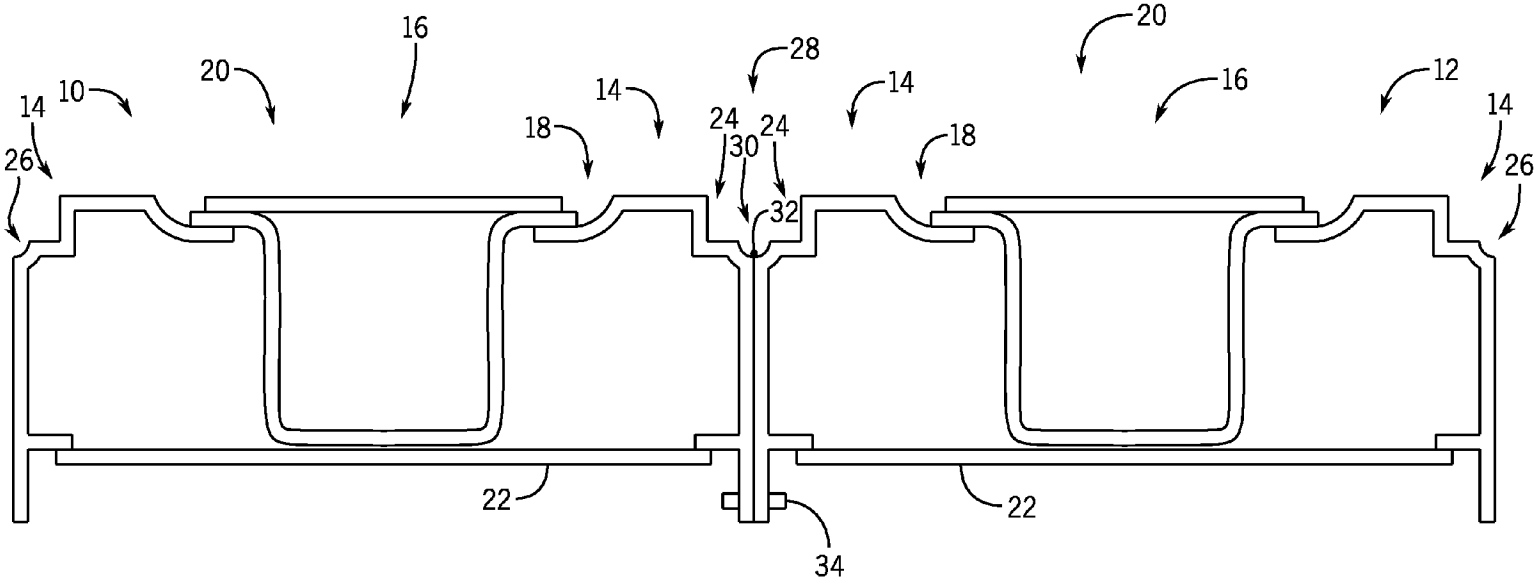
FIG. 1 is a schematic cross-sectional view of an embodiment of two adjacent roof panels, in accordance with aspects of the present disclosure.

FIG. 1 is a schematic cross-sectional view of a first roof panel 10 and a second roof panel 12 utilized to form a full-contact floating roof. As shown, the first and second roof panels 10, 12 are formed from frame segments 14. Moreover, adjacent frame segments 14 of the first and second roof panels 10, 12 are coupled (e.g., welded, bolted, riveted, clamped) to one another to form the floating roof. The following discussion will refer to the first roof panel 10, for clarity. However, it will be appreciated that the first and second roof panels 10, 12 are configured to utilize substantially similar components to facilitate manufacturing and assembly.

In the illustrated embodiment, the first roof panel 10 includes a panel component 16 coupled to the frame segments 14. The panel component 16 may be welded or otherwise coupled to the frame segments 14 about a perimeter 18 of the panel component 16. As a result, the panel component 16 may form a pressure-containing section 20 (e.g., a sealed cavity) of the first roof panel 10. That is, the panel component 16 may be utilized to substantially isolate the interior of the storage tank from the surrounding atmosphere by coupling to the frame segments 14 on the outside surface of the storage tank. Moreover, the first roof panel 10 includes at least one panel strip 22 extending between the frame segments 14. As will be described in detail below, in certain embodiments, the panel component 16 is configured to contact the panel strip 22. In the illustrated embodiment, the panel strip 22 is also configured to provide structural rigidity to the first roof panel 10. For example, the panel strip 22 may be welded to the frame segment 14 and absorb at least a portion of the load exerted on the frame segments 14 by the interior pressure of the storage tank.

As will be described in detail below, the frame segments 14 each include a first depression 24 and a second depression 26. By aligning adjacent frame segments 14, a walled trough 28 may be formed between adjacent roof panels 10, 12, thereby enabling coupling of the adjacent roof panels 10, 12. In certain embodiments, an automatic welder may be directed through or along the walled trough 28 to join the adjacent first and second roof panels 10, 12 together via a welding process. For example, the corresponding second depressions 26 of adjacent roof panels 10, 12 may form a groove 30 in which a weld seam 32 may be formed. Furthermore, in the illustrated embodiment, the frame segments 14 may be mechanically joined by a fastener 34 (e.g., a bolt, a rivet, a clamp). The fastener 34 may be utilized during assembly of the floating roof before welding the roof panels 10, 12 together, while the weld seam 32 may provide sufficient strength to permanently couple the first and second roof panels 10, 12 together. However, in other embodiments, the fastener 34 may be permanently used to increase the structural stability of the floating roof.

Figure 2:
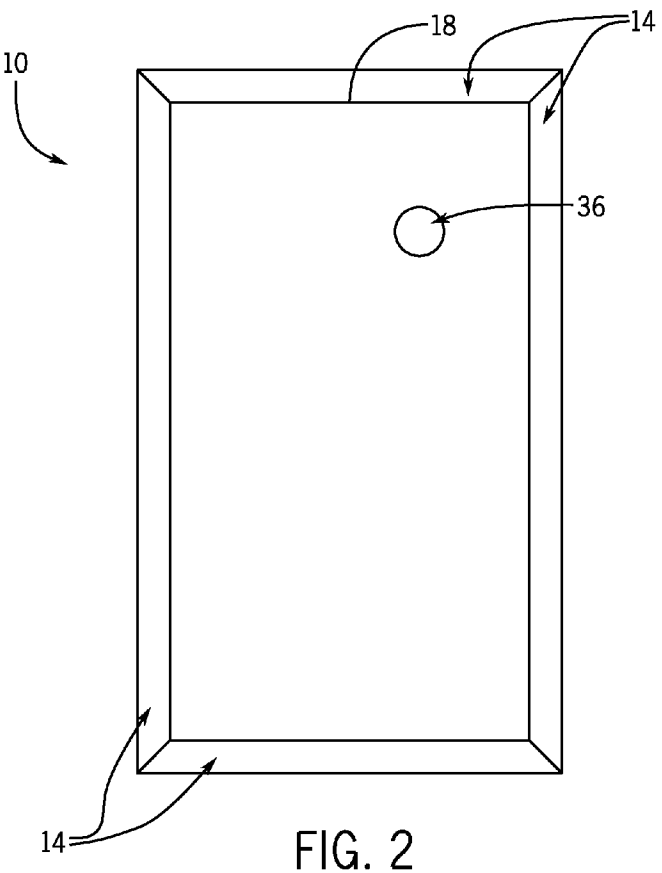
FIG. 2 is a schematic top view of an embodiment of a roof panel, in accordance with aspects of the present disclosure.

FIG. 2 is a top view of the first roof panel 10 in an assembled configuration. As shown, the frame segments 14 may be angle-cut at the corners to form a substantially rectangular roof panel. As mentioned above, the first roof panel 10 may be assembled before reaching the work site, thereby enabling inspection and/or testing of the first roof panel 10 in a controlled environment. In the illustrated embodiment, the perimeter 18 of the panel component 16 is coupled to the frame segments 14 via a welding process. As described below, the pressure containing portions of the first roof panel 10 (e.g., the pressure-containing section 20, the panel component 16) may only be coupled to the first roof panel 10 on the outside surface of the first roof panel 10. As a result, the welds coupling the pressure-containing section 20 and the panel component 16 to the frame segments 14 may not be exposed to the fluid within the storage tank. In certain embodiments, the panel component 16 may include one or more openings 36 (e.g., apertures) to provide access to the interior portion or volume of the first roof panel 10. For example, detection equipment, sensors, or the like may be lowered into first roof panel 10 via the opening 36. It will be appreciated that the opening 36 may be a sealable opening or aperture (e.g., plugged, welded, bolted, etc.).

Figure 3:
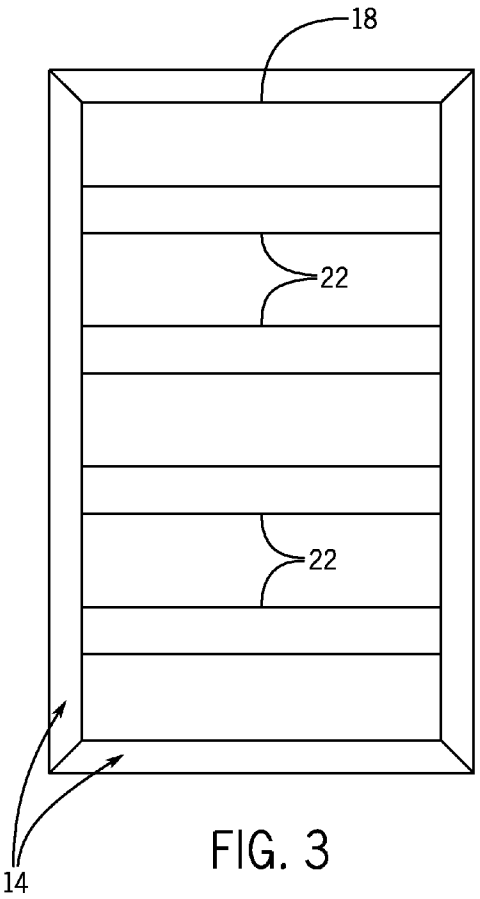
FIG. 3 is a schematic bottom view of the roof panel of FIG. 2, in accordance with aspects of the present disclosure.

FIG. 3 is a bottom view of the first roof panel 10 in an assembled configuration. As described above, the segments 14 may be angle-cut to form a substantially rectangular roof panel. Moreover, the panel strips 22 are configured to extend across the first roof panel 10 to provide structural support for the first roof panel 10 and/or for the panel component 16. In the illustrated embodiment, the panel strips 22 run horizontally across the top roof panel 10. However, in other embodiments, the panel strips 22 may run vertically across the first roof panel 10 or both horizontally and vertically. As mentioned above, the panels strips 22 may be coupled (e.g., welded) to the frame segments 14, thereby increasing the structural rigidity of the first roof panel 10. It will be appreciated that the welds coupling the panel strips 22 to the frame segments 14 may be structural welds and not pressure-containing welds.

Figure 4:
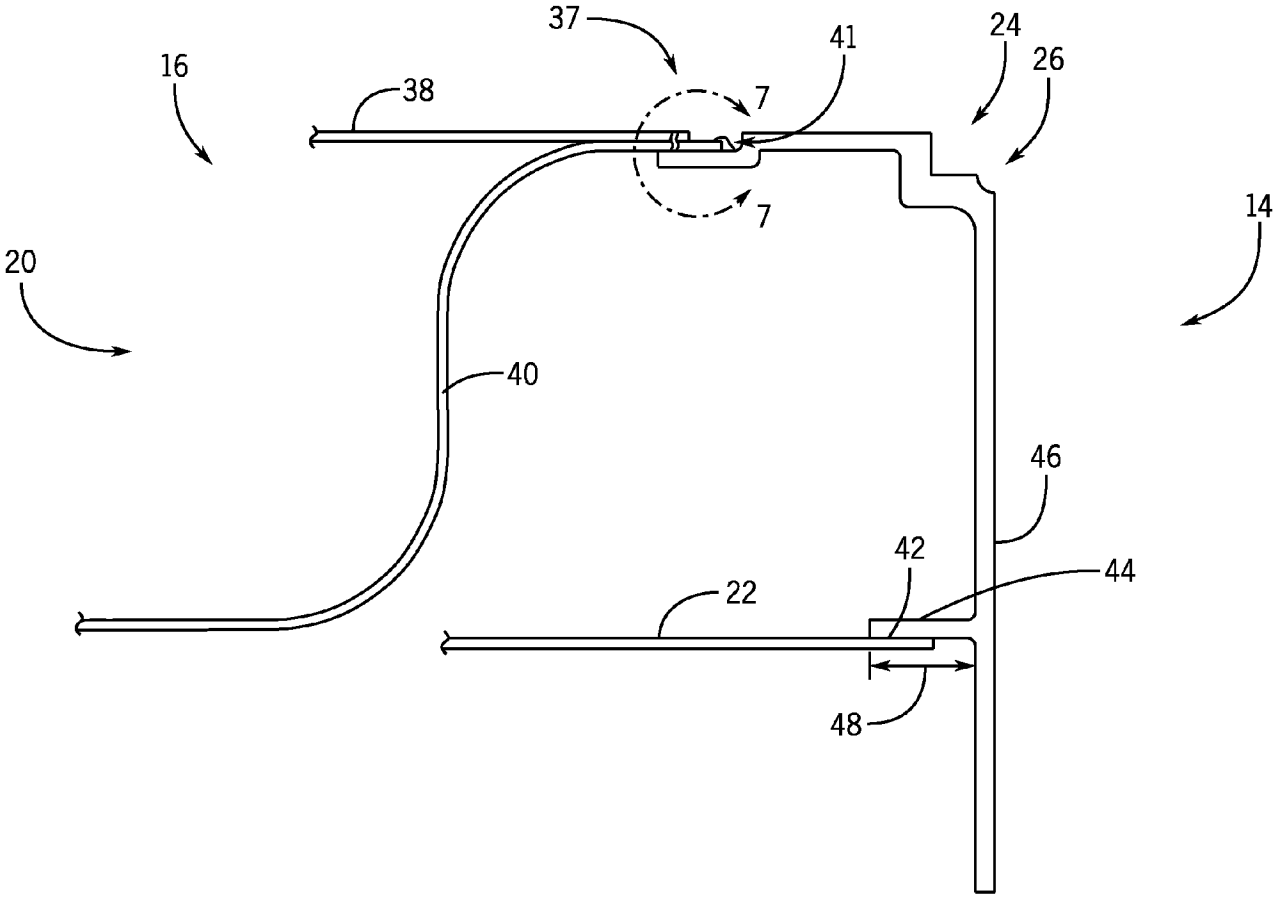
FIG. 4 is a partial schematic cross-sectional side view of an embodiment of a roof panel, in accordance with aspects of the present disclosure.

FIG. 4 is a partial schematic cross-sectional side view of the first roof panel 10. As described above, the first roof panel 10 is configured to form the floating roof of the storage tank in which the pressure-containing welds are positioned on the outside surface of the floating roof. In the illustrated embodiment, the first roof panel 10 includes the frame segment 14 coupled to the panel component 16 and one of the panel strips 22. In certain embodiments, the frame segment 14 is an extruded part formed from a strong, lightweight material (e.g., aluminum, composite material, polymer, etc.). By positioning the weld joints between the frame segment 14 and the panel component 16 outside of the tank (e.g., on an exterior surface 37 of the floating roof), exposure of the weld joints to the fluid inside the storage tank may be reduced and/or substantially eliminated. As a result, the likelihood of degradation to the connection may be substantially reduced. Moreover, the likelihood of leakage and/or loss of product within the storage tank may also be reduced.

As will be described in detail below, the panel component 16 includes a top sheet 38 and a pan 40 (e.g., a pan-shaped bottom sheet). The top sheet 38 and the pan 40 are configured to be coupled (e.g., welded, bonded, etc.) to form the panel component 16. Moreover, the top sheet 38 and the pan 40 form the pressure-containing section 20 of the first roof panel 10. Connecting the panel component 16 to the frame segment 14 substantially isolates the interior of the storage tank from the environment, thereby sealing the floating roof. Moreover, by forming the pressure-containing section 20 by joining the top sheet 38 to the pan 40, the connection between the panel component 16 and the frame segment 14 may be made on the exterior surface 37 (e.g., outside surface) of the first roof panel 10, as indicated by reference numeral 41. As a result, the pressure-containing weld may not be exposed to the fluid within the storage tank.

The panel component 16 is configured to isolate the fluids within the tank from the environment. As shown, the panel component 16 is rigidly coupled to the frame segment 14. For example, the panel component 16 may be coupled to the frame segment 14 to form the roof panel 10 in a shop or factory before the entire floating roof is assembled at a work site (e.g., storage tank location). In certain embodiments, the panel component 16 is welded to the frame segment 14. However, in other embodiments, the panel component 16 may be bonded, bolted, riveted, or otherwise coupled to the frame segment 14. Furthermore, the panel component 16 is configured to contact the panel strip 22. In other words, the panel strip 22 may be configured to support the panel component 16 when the panel component 16 is coupled to the frame segment 14. For example, the panel strip 22 may support the panel component 16 during installation and/or fabrication of the first roof panel 10. Moreover, the panel strip 22 may increase the rigidity of the lattice frame structure of the floating roof. As shown, the panel strip 22 is coupled to a bottom side 42 of a frame extension 44 (e.g., lower lip, lower frame extension). However, in other embodiments, the panel strip 22 may be coupled to a top side of the frame extension 44. In the illustrated embodiment, the frame extension 44 extends from a frame section 46 a first length 48. It will be appreciated that the first length 48 may be adjusted to reduce the material utilized to form the frame segment 14. Moreover, adjustments to the first length 48 may have an inverse relation to a length of the panel strip 22. For example, a smaller first length 48 may facilitate use of a longer panel strip 22.

Figure 5:
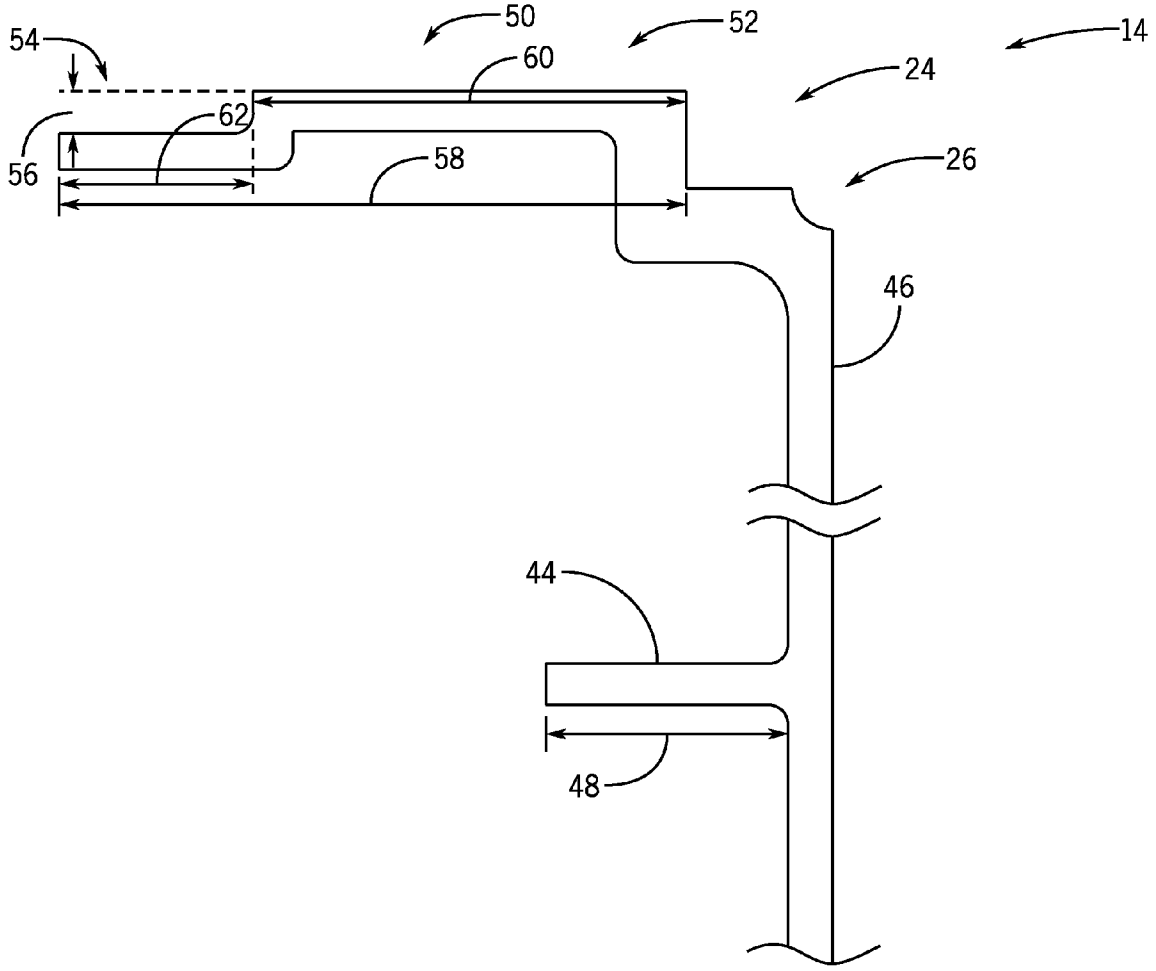
FIG. 5 is a schematic cross-sectional side view of an embodiment of a frame of the roof panel of FIG. 4, in accordance with aspects of the present disclosure.

FIG. 5 is a partial cross-sectional view of the frame segment 14. As shown, the frame segment 14 includes a lip 50 (e.g., upper lip) configured to receive and support the panel component 16. In the illustrated embodiment, the lip 50 includes a raised section 52 and a recessed section 54. A first depth 56 of the recessed section 54 is configured to receive the panel component 16 such that the panel component 16 is substantially planar (e.g., flush) with the raised section 52. Moreover, the lip 50 includes a second length 58 extending from the first depression 24. In the illustrated embodiment, the second length 58 comprises a third length 60 and a fourth length 62. In certain embodiments, the third length 60 is substantially equal to the fourth length 62. However, in other embodiments, the third length 60 is longer than the fourth length 62 or shorter than the fourth length 62. It will be appreciated that the relative lengths of the third length 60 and the fourth length 62 may be adjusted according to design conditions. For example, the lip 50 may be longer to enable smaller panel components 16. In addition, in other embodiments, the lip 50 may be shorter to reduce the weight and material utilized to form the frame segment 14.

As described above, the frame segment 14 of the first roof panel 10 includes the first depression 24 and the second depression 26. The frame segment 14 is configured to align with another corresponding, adjacent frame segment 14 of another roof panel (e.g., roof panel 12) such that the respective frame segments 14 are in contact with one another. As a result, the walled trough 28 may be formed between the adjacent frame segments 14. Accordingly, in certain embodiments, an automatic welder may form the weld seam 32 along the second depressions 26. As will be described below, the automatic welder may include wheels that guide the welder along the walled trough 36.

Figure 6:
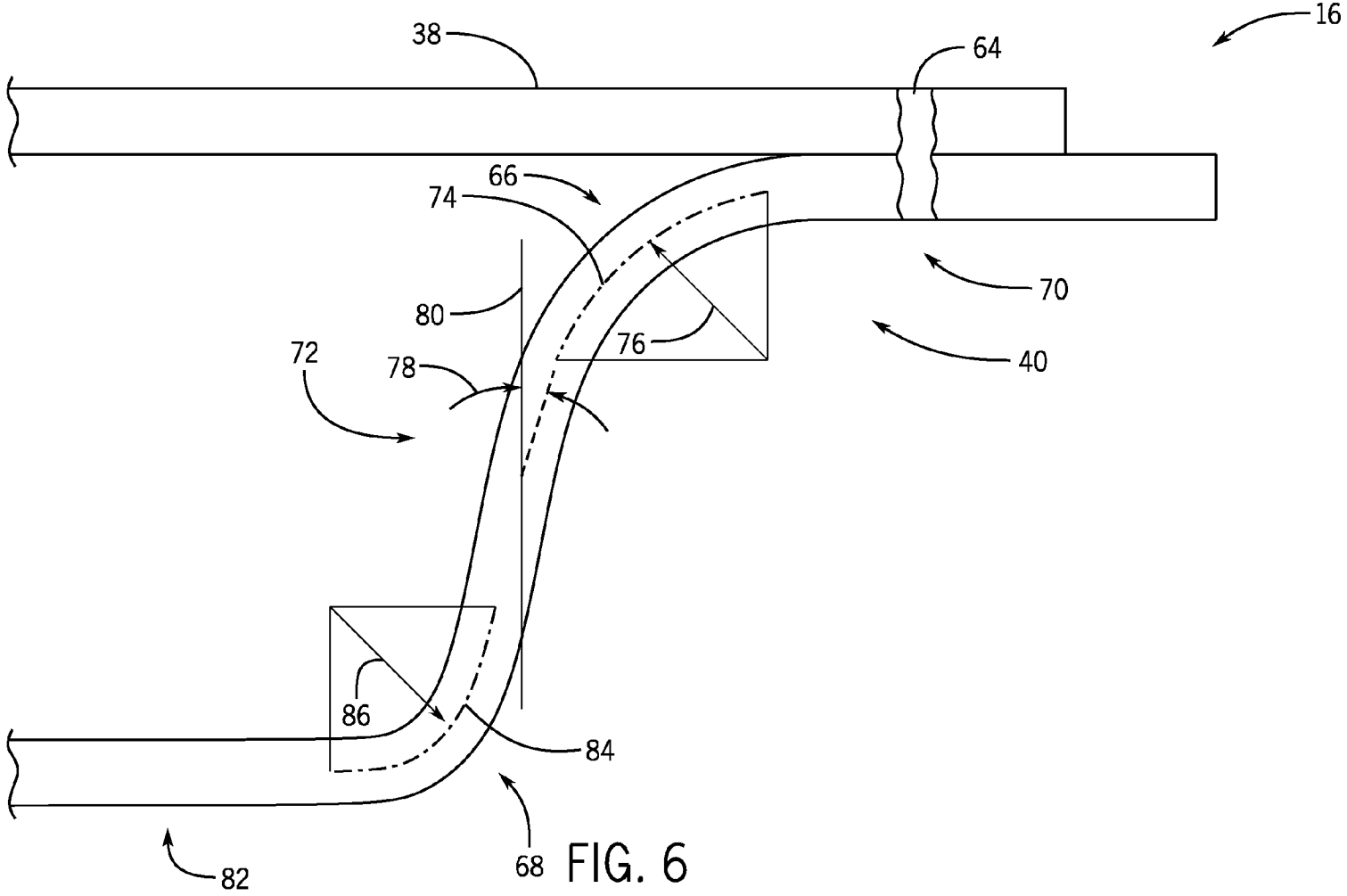
FIG. 6 is a schematic cross-sectional side view of an embodiment of a panel component of the roof panel of FIG. 4, in accordance with aspects of the present disclosure.

FIG. 6 is a partial schematic cross-sectional view of the panel component 16. As described above, the panel component 16 is configured to couple to the frame segment 14 to substantially block internal fluid and/or vapors in the storage tank from entering the atmosphere. In the illustrated embodiment, the panel component 16 includes a top sheet 38 and a pan 40 coupled via a joint 64. The joint 64 is configured to rigidly bond the top sheet 38 to the pan 40, thereby forming the panel component 16. In certain embodiments, the top sheet 38 may be seam welded to the pan 40. As will be appreciated, during the seam welding process, the top sheet 38 is compressed against the pan 40 while an electrical current heats the top sheet 38 and the pan 40. As the top sheet 38 and the pan 40 are heated, the top sheet 38 and the pan 40 may experience localized melting, thereby facilitating integral bonding between the top sheet 38 and the pan 40. While the top sheet 38 and the pan 40 are heated, the top sheet 38 and the pan 40 are compressed together. As the top sheet 38 and the pan 40 cool, the compressed sections cool together, forming the integrally bonded joint 64 to couple the top sheet 38 to the pan 40. However, in other embodiments, the top sheet 38 may be otherwise coupled to the pan 40. For example, the top sheet 38 may be clamped, bolted, riveted, bonded, or the like to the pan 40 to facilitate coupling. As will be described in detail below, the pan 40 may be configured to extend toward the frame segment 14 farther than the top sheet 38. That is, the perimeter 18 of the panel component 16 may refer to the perimeter of the pan 40.

In the illustrated embodiment, the pan 40 includes a first curved section 66 and a second curved section 68. The first curved section 66 extends from a first horizontal section 70 of the pan 40 toward a vertical section 72 (e.g., generally vertical section) of the pan 40. In the illustrated embodiment, the vertical section 72 is not perpendicular to the top sheet 38. Moreover, the first curved section 66 extends a first arc length 74 between the first horizontal section 70 and the vertical section 72. It will be appreciated that the first arc length 74 may be particularly selected to accommodate the operating conditions of the tank. For example, the first arc length 74 may be larger to enable a longer first curved section 66. In certain embodiments, longer first arc lengths 74 may enable fabrication of the first curved section 66 via a rolling process. However, in other embodiments, the first arc length 74 may be shorter to facilitate increased rigidity of the pan 40. In certain embodiments, the shorter first arc length 74 may enable fabrication of the first curved section 66 via a stamping or pressing process. Moreover, in other embodiments, the first curved section 66 may be defined by a first radius of curvature 76. As described above with respect to the first arc length 74, the first radius of curvature 76 may be particularly selected according to design conditions. As mentioned above, the first curved section 66 extends toward the first vertical section 72. In certain embodiments, the vertical section 72 may be positioned at a first angle 78 with respect to an axis 80 positioned substantially perpendicular to the top sheet 38. In the illustrated embodiment, the vertical section 72 is angled relative to the top sheet 38. However, in other embodiments, the vertical section 72 may be substantially perpendicular to the top sheet 38. As will be appreciated, positioning the vertical section 72 at the first angle 78 with respect to the top sheet 38 may enable the vertical section 72 to deflect upward or downward forces. For example, an upward force within the tank (e.g., due to pressure increase), may be deflected along the vertical section 72 toward the first curved section 66, thereby distributing the internal force within the tank along the pan 40.

Additionally, the second curved section 68 extends from the vertical section 72 to a second horizontal section 82. Furthermore, the second curved section 68 extends a second arc length 84. In certain embodiments, the second arc length 84 is substantially equal to the first arc length 74. However, in other embodiments, the second arc length 84 may be longer than the first arc length 74 or the second arc length 84 may be shorter than the first arc length 74. Moreover, in other embodiments, the second curved section 68 may be described by a second radius of curvature 86. As described above with respect to the second arc length 84, the second radius of curvature 86 may be particularly selected according to design conditions. As will be appreciated, the first and second curved sections 66, 68 may be configured to produce a generally S-shaped bend along the edges of the pan 40. Accordingly, the first and second curved sections 66, 68 may be configured to flex and/or bend to accommodate pressure changes within the tank. Movement and or bending of the pan enables internal pressure to be distributed over a larger surface area, thereby improving reliability and longevity of the pan 40 and the first roof panel 10.

Figure 7:
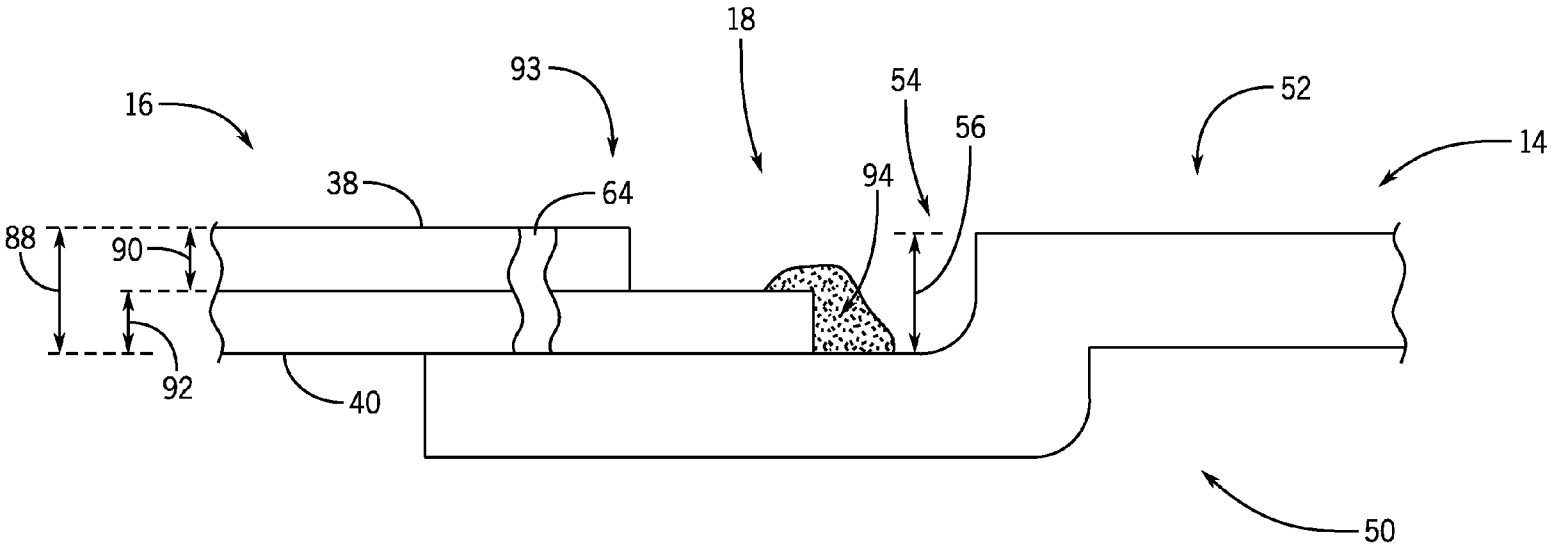
FIG. 7 is a partial schematic cross-sectional side view of the roof panel of FIG. 4, taken along line 7-7, in accordance with aspects of the present disclosure.

FIG. 7 is a partial schematic cross-sectional view of the panel component 16 coupled to the frame segment 14 taken along line 7-7. As described above, the panel component 16 is positioned within the recessed section 54 of the lip 50. In the illustrated embodiment, the panel component 16 includes a second depth 88 that is substantially equal to the first depth 56. However, in other embodiments, the second depth 88 may be larger than the first depth 56, or the second depth 88 may be smaller than the first depth 56. The second depth 88 includes a third depth 90 corresponding to a thickness of the top sheet 38 and a fourth depth 92 corresponding to a thickness of the pan 40. In certain embodiments, the third depth 90 is substantially equal to the fourth depth 92. However, in other embodiments, the third depth 90 is larger than the fourth depth 92, or the third depth 90 is smaller than the fourth depth 92. As will be appreciated, in embodiments where the second depth 88 is substantially equal to the first depth 56, the panel component 16 may be substantially flush with the raised section 52, thereby forming a substantially level walking surface of the roof panel 10.

In the illustrated embodiment, the pan 40 extends farther into the recessed section 54 than the top sheet 38. In other words, an edge of the pan 40 (e.g., the perimeter 18) is closer to the raised section 52 than an edge of the top sheet 38 (e.g., a perimeter 93). As a result, gaps between the top sheet 38 and the pan 40 may be reduced or substantially eliminated while the panel component 16 is coupled to the frame segment 14. For example, a weld 94 may be deposited on the pan 40, thereby coupling the panel component 16 to the frame segment 14. As described above, the weld 94 may be performed away from the location of the storage tank (e.g., not in the field), thereby enabling testing and/or inspection before assembly of the floating roof. In certain embodiments, heat from the weld may induce growth and/or localized heating of the pan 40. By forming an offset between the top sheet 38 and the pan 40 for the weld 94, gaps and/or separation between the top sheet 38 and the pan 40 may be reduced or substantially eliminated, thereby facilitating an improved seal between the top sheet 38 and the pan 40. Furthermore, by coupling the panel component 16 to the frame segment 14 on the outside (e.g., within the lip 50 and not exposed to the product within the tank) reliability of the weld 94, and therefore the connection between the panel component 16 and the frame segment 14, may be improved. For example, by removing the weld 94 from exposure to the product within the tank, the likelihood of corrosion, stress-cracking, leakage, or the like in the roof panel 10 may be reduced. Furthermore, by positioning the weld 94 on the outside of the panel component 16 and the roof panel 10, follow up inspection and repairs may be facilitated, improved, and/or simplified. Moreover, as shown in the illustrated embodiment, the joint 64 is also positioned within the recessed section 54, further isolating the welded area of the panel component 16 from the products within the tank.

Figure 8:
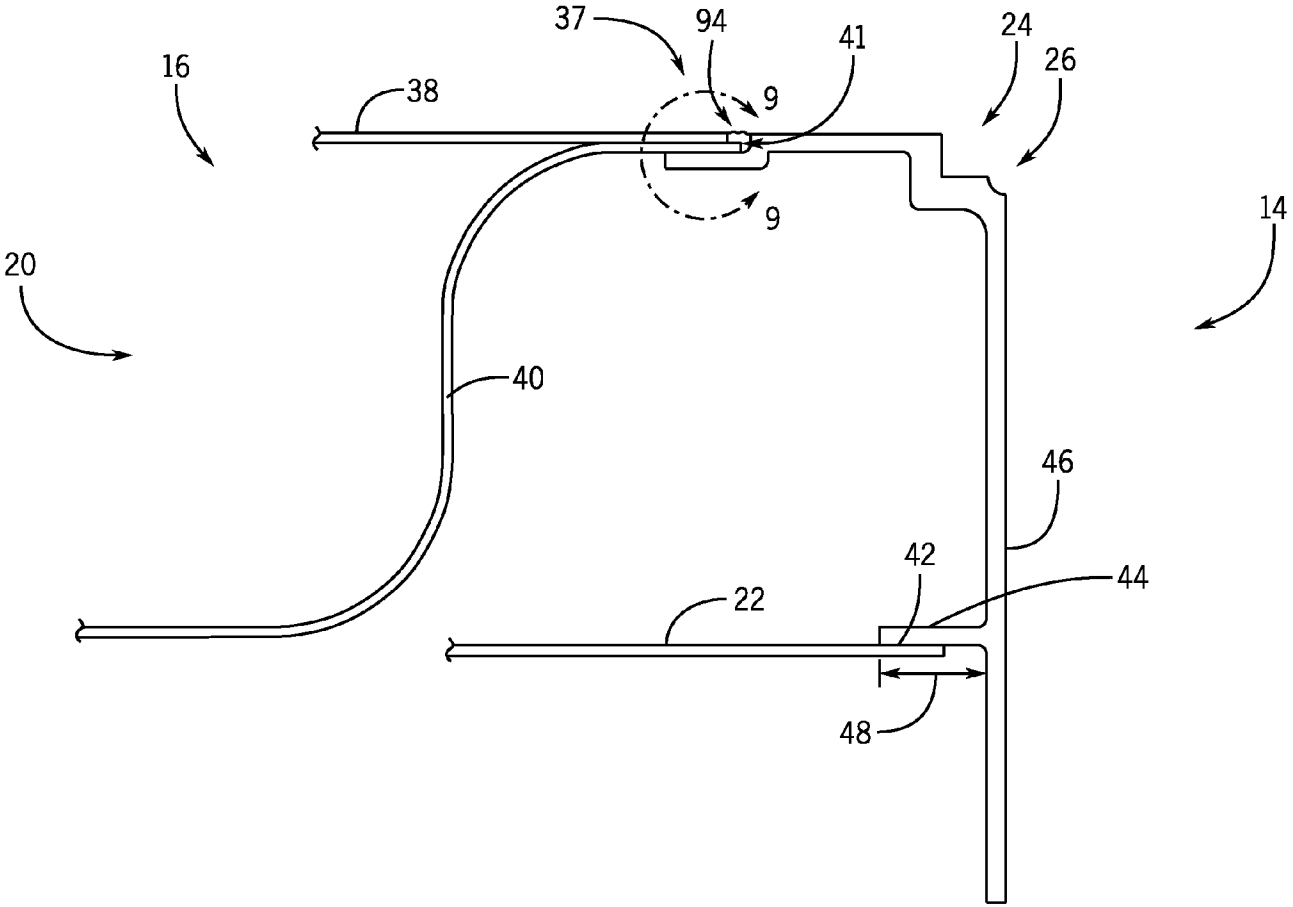
FIG. 8 is a partial schematic cross-sectional side view of an embodiment of a roof panel, in accordance with aspects of the present disclosure.

FIG. 8 is a partial schematic cross-sectional side view of an embodiment of the first roof panel 10. As described above, the first roof panel 10 is configured to form the floating roof of the storage tank in which the pressure-containing welds are positioned on the outside surface of the floating roof. In the illustrated embodiment, the first roof panel 10 includes the frame segment 14 coupled to the panel component 16 and one of the panel strips 22. As described above, by positioning the weld joints between the frame segment 14 and the panel component 16 outside of the tank (e.g., on the exterior surface 37 of the floating roof), exposure of the weld joints to the fluid inside the storage tank may be reduced and/or substantially eliminated. As a result, the likelihood of degradation to the connection between the frame segment 14 and the panel component 16 may be substantially reduced. Moreover, the likelihood of leakage and/or loss of product within the storage tank may also be reduced.

In the illustrated embodiment, the top sheet 38 is coupled to the pan 40 to form the panel component 16. Moreover, the weld 94 coupling the panel component 16 to the frame segment 14 is also configured to join the top sheet 38 to the pan 40. As a result, the seal welding process to form the joint 64 may not be utilized in the illustrated embodiment. As described above, utilizing the weld 94 to form the panel component 16 enables the pressure-containing weld 94 to be formed on the exterior surface 37 of the first roof panel 10, thereby substantially isolating the pressure-containing weld 94 from the fluid within the storage tank.

Figure 9:
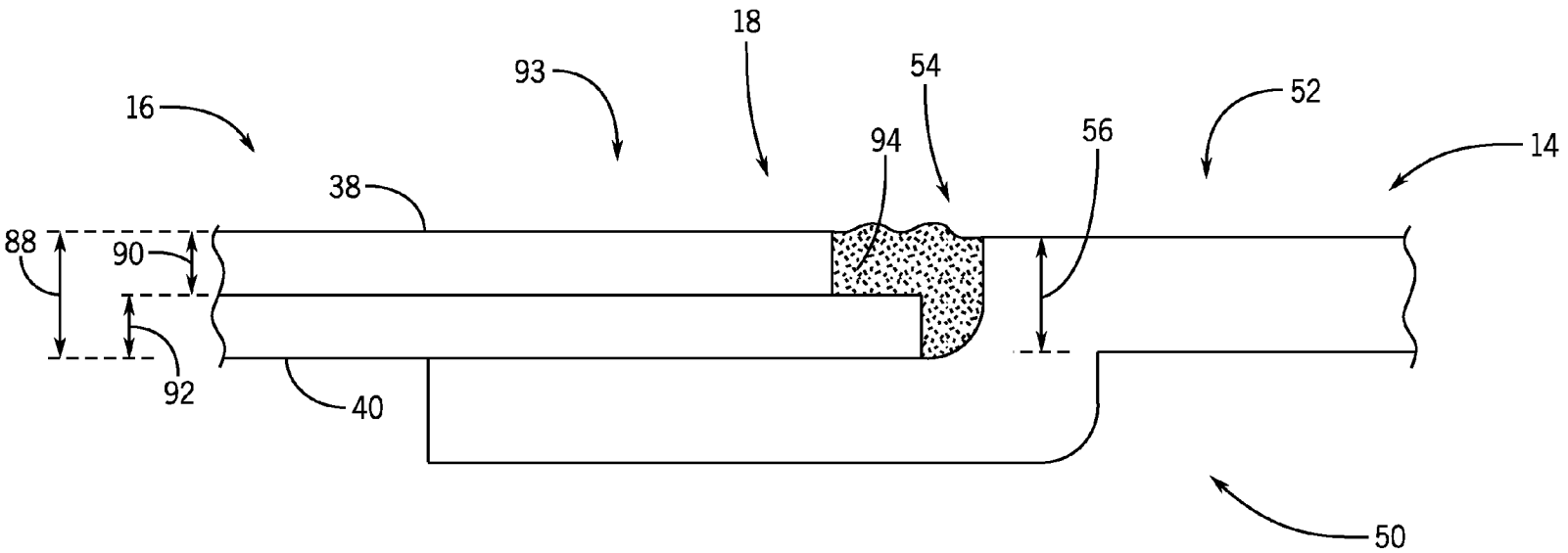
FIG. 9 is a partial schematic cross-sectional side view of the roof panel of FIG. 8, taken along line 9-9, in accordance with aspects of the present disclosure.

FIG. 9 is a partial schematic cross-sectional view of the panel component 16 coupled to the frame segment 14 taken along line 9-9 of FIG. 8. As described above, the panel component 16 is positioned within the recessed section 54 of the lip 50. In the illustrated embodiment, the weld 94 is configured to couple the top sheet 38 to the pan 40 to form the panel component 16 and also to couple the panel component 16 to the frame segment 14. In certain embodiments, the weld 94 is configured to substantially fill the second depth 88, thereby enabling a substantially planar and/or level transition between the panel component 16 and the raised section 52 of the frame segment 14. However, in other embodiments, the weld 94 may not completely or substantially fill the second depth 88. As described above, by forming the weld 94 on the exterior surface 37, the pressure-containing weld 94 may be substantially isolated from the fluid within the storage tank.

In the illustrated embodiment, the pan 40 extends farther into the recessed section 54 than the top sheet 38. In other words, an edge of the pan 40 (e.g., the perimeter 18) is closer to the raised section 52 than an edge of the top sheet 38 (e.g., a perimeter 93). As a result, gaps between the top sheet 38 and the pan 40 may be reduced or substantially eliminated while the panel component 16 is coupled to the frame segment 14. For example, the weld 94 may be deposited on the pan 40, thereby coupling the panel component 16 to the frame segment 14. As described above, the weld 94 may be performed away from the location of the storage tank (e.g., not in the field), thereby enabling testing and/or inspection before assembly of the floating roof. In certain embodiments, heat from the weld may induce growth and/or localized heating of the pan 40. By forming an offset between the top sheet 38 and the pan 40 for the weld 94, gaps and/or separation between the top sheet 38 and the pan 40 may be reduced or substantially eliminated, thereby facilitating an improved seal between the top sheet 38 and the pan 40. Furthermore, by coupling the panel component 16 to the frame segment 14 on the outside (e.g., within the lip 50 and not exposed to the product within the tank) reliability of the weld 94, and therefore the connection between the panel component 16 and the frame segment 14, may be improved. For example, by removing the weld 94 from exposure to the product within the tank, the likelihood of corrosion, stress-cracking, leakage, or the like in the roof panel 10 may be reduced. Furthermore, by positioning the weld 94 on the outside of the panel component 16 and the roof panel 10, follow up inspection, maintenance, and/or repairs may be facilitated, improved, and/or simplified.

Figure 10:
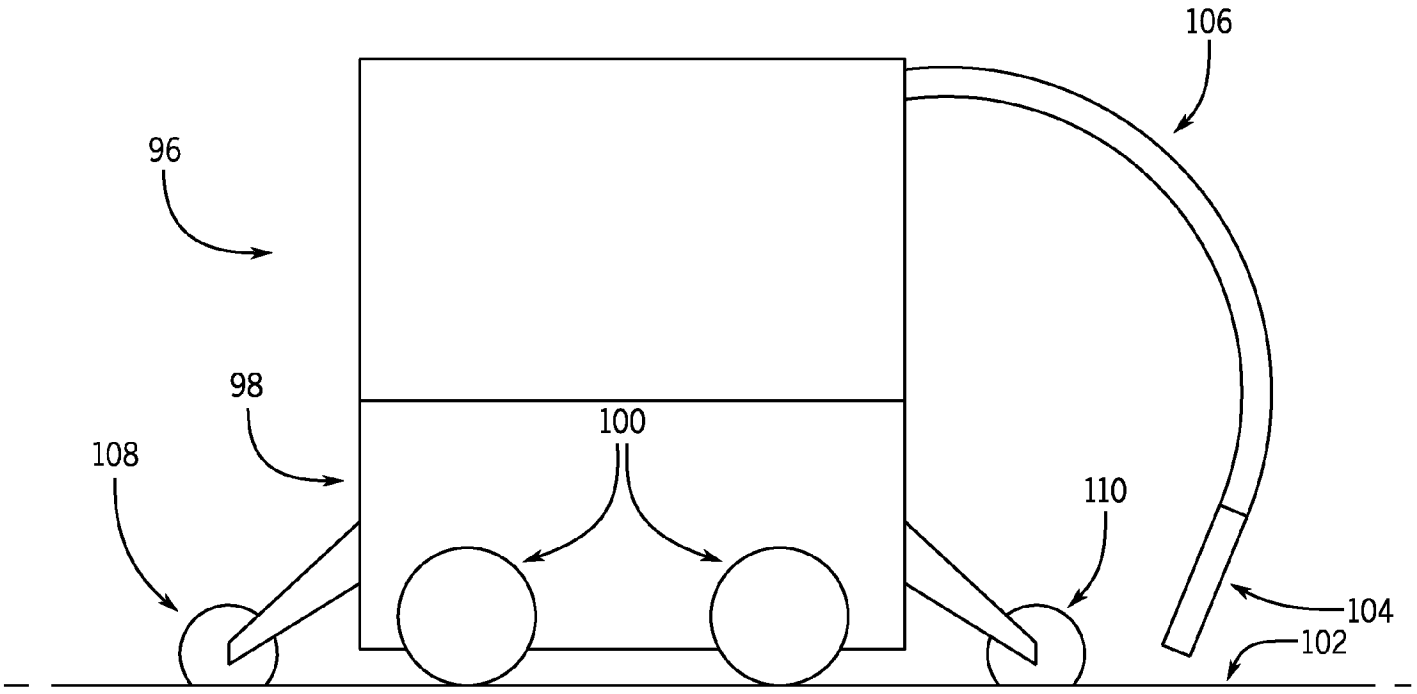
FIG. 10 is a schematic view of an embodiment of an automatic welder positioned on a roof panel, in accordance with aspects of the present disclosure.

FIG. 10 is a schematic side view of an embodiment of an automatic welder 96 configured to deposit the weld seam 32 along the groove 30 formed by the second depressions 26 to couple adjacent roof panels 10, 12. As described above, in certain embodiments, the automatic welder 96 may utilize the walled trough 28 as a guide. In the illustrated embodiment, the automatic welder 96 includes a carriage 98 mounted on wheels 100, enabling the automatic welder 96 to travel along a surface 102 (e.g., outer surface) of the floating roof. Moreover, a weld head 104 positioned on an end of a control arm 106 may deposit weld metal to form the weld seam 32 along the groove 30. For example, the automatic welder 96 may receive instructions from a controller to position the weld head 104 via the control arm 106. Furthermore, in the illustrated embodiment, guide wheels 108, 110 may be coupled to the automatic welder 96 and positioned within the walled trough 28. As a result, the automatic welder 96 may travel along the walled trough 28 as welding operations occur. Furthermore, in certain embodiments, the controller may output control signals to the guide wheels 108, 110 to increase or decrease the speed of the automatic welder 96. However, in other embodiments, different control systems such as radio frequency controls, direct steering, wired controls, wireless controls, or the like may be utilized to control the guide wheels 108, 110 and/or the automatic welder 96.

Figure 11:
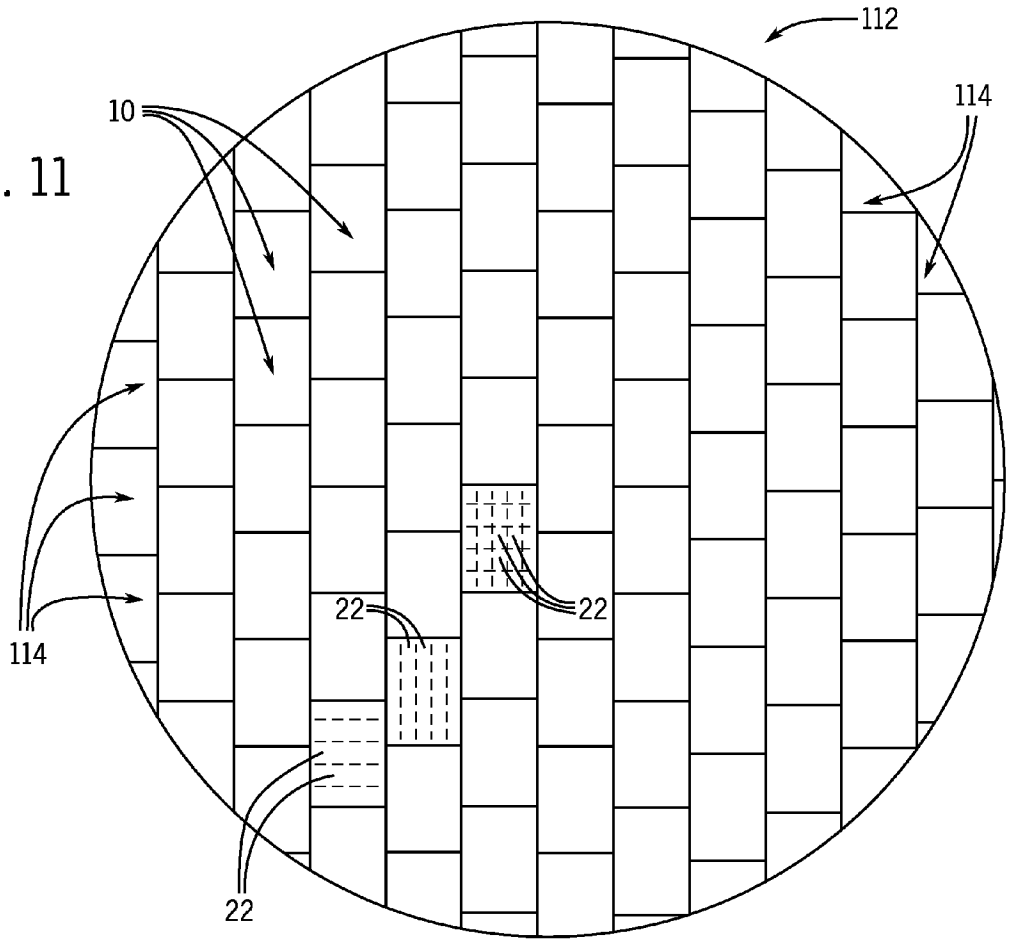
FIG. 11 is a schematic top view of an embodiment of an assembled full-contact floating roof utilizing the roof panel of FIG. 5, in accordance with aspects of the present disclosure.

FIG. 11 is a schematic top view of an embodiment of a floating roof 112 assembled utilizing roof panels 10, 12 formed from the panel component 16 and the frame segments 14. As will be appreciated, edge panels 114 comprising the edges of the floating roof 112 may include curved edges. In the illustrated embodiment, the panel strips 22 extend along the roof panels 10, 12, thereby supporting the panel components 16, as described above. As shown, the panel strips 22 may run horizontally, vertically, or in both directions. The roof panels 10, 12 may be welded together via the automatic welder 96 along the walled trough 36. However, in other embodiments, the panels 10, 12 may be otherwise coupled. For example, in certain embodiments, the panels 10, 12 may be bolted, riveted, or the like. Accordingly, the panels 10, 12 may be utilized to form the floating roof 112 in which the panel component 16 is welded to the frame segment 14 only on the outside of the floating roof 112 (e.g., an outside surface of the roof panels 10, 12), thereby substantially isolating the weld 94 from the product within the tank.

As described in detail above, embodiments of the present disclosure are directed to the floating roof 112 formed by roof panels 10, 12 having pressure-containing welds 94 located on the outer surface 102 of the floating roof 112, thereby substantially isolating the pressure containing welds 94 from exposure to the product within the storage tank. For example, the panel component 16 may be coupled to the frame segments 14 along the perimeter 18 to form the first roof panel 10. In certain embodiments, the panel component 16 includes the top sheet 38 and the pan 40. The top sheet 38 and the pan 40 may be coupled via the joint 64 to form a pressure-containing section 20 of the first roof panel 10. The panel component 16 may be positioned within a lip 50 of the frame segment 14, and welded to the frame segment 14 within the lip 50. As a result, the weld 94 coupling the panel component 106 to the frame segment 14 may be substantially isolated from exposure to product within the storage tank. Accordingly, the life of the weld 94 may be improved and/or leakage from the storage tank may be substantially reduced or eliminated. In certain embodiments, the roof panels 10, 12 may be positioned adjacent to one another and coupled via the automatic welder 96. Accordingly, the welded floating roof 112 may be formed.

The above examples are included for demonstration purposes only and not as limitations on the scope of the disclosure. Other variations in the construction of the disclosure may be made without departing from the spirit of the disclosure, and those of skill in the art will recognize that these descriptions are provide by way of example only.

The invention claimed is:

1. A roof panel of a sealed floating roof for a storage tank, comprising:

a first frame segment and a second frame segment, wherein each of the first and second frame segments comprises:

an upper lip comprising a recessed section; and a first depression configured to abut an adjacent top depression of a respective frame segment of a respective adjacent roof panel to form a walled trough to guide an automatic welder along a weld joint during a welding process; and a panel component comprising a top sheet and a pan-shaped bottom sheet coupled to the top sheet, wherein a respective distal end of the pan-shaped bottom sheet is coupled to one of the respective upper lips of the first and second frame segments, and wherein the respective distal end of the pan-shaped bottom sheet rests on the respective recessed section of the respective upper lip of the first or second frame segment and extends laterally beyond a perimeter of the top sheet such that top sheet may be welded to a top surface of the pan-shaped bottom sheet.

2. The roof panel of claim 1, comprising a panel strip coupled to and extending between respective lower lips of each of the first and second frame segments.

3. The roof panel of claim 2, wherein the panel component rests on the panel strip.

4. The roof panel of claim 1, wherein the top sheet comprises a sealable aperture configured to provide access to an interior of the storage tank.

5. The roof panel of claim 1, wherein top sheet and the pan-shaped bottom sheet are welded to one another on an exterior surface of the panel component.

6. The roof panel of claim 1, wherein the pan-shaped bottom sheet comprises a first curved section and a second curved section configured to bend in response to pressure within the storage tank.

7. The roof panel of claim 1, wherein the top sheet is planar.

8. The roof panel of claim 1, wherein the panel component is coupled to the frame only on an exterior surface of the roof panel.

9. The roof panel of claim 1, wherein the panel component comprises a rectangular shape.

10. The roof panel of claim 1, wherein the walled trough is configured to retain and guide the automatic welder along the weld joint during the welding process.

11. A sealed floating roof for a storage tank, comprising:

a plurality of roof panels positioned adjacent to one another, wherein each of the plurality of roof panels comprises:

a first frame segment comprising a first upper lip having a first recessed section;

a second frame segment comprising a second upper lip extending toward the first upper lip, wherein the second upper lip comprises a second recessed section; and a panel component comprising a pan and a top sheet coupled to the pan, wherein a first perimeter of the pan extends laterally beyond a second perimeter of the top sheet and rests on the first recessed section and the second recessed section such that top sheet may be welded to a top surface of the pan, and wherein the pan is coupled to the first upper lip and the second upper lip by a weld on an exterior surface of each of the first and second upper lip.

12. The sealed floating roof of claim 11, wherein each of the first and second frame segments comprises a frame extension extending toward one another.

13. The sealed floating roof of claim 12, comprising a panel strip extending between the first and second frame segments, wherein the panel strip is coupled to the respective frame extensions of the first and second frame segments.

14. The sealed floating roof of claim 13, wherein the top sheet is coupled to the pan about the second perimeter of the top sheet.

15. A roof panel of a sealed floating roof for a storage tank, comprising:

a first frame segment comprising a first upper lip comprising a first recessed section, and a first lower frame extension;

a second frame segment comprising a second upper lip comprising a second recessed section, and a second lower frame extension; and a panel component coupled to the first and second recessed sections of the first and second upper lips, respectively, wherein the panel component comprises:

a top sheet; and a pan comprising a first distal end coupled to the first upper lip and a second distal end coupled to the second upper lip, wherein the first and second distal ends extend outward beyond a perimeter of the top sheet such that top sheet may be welded to a top surface of the pan, wherein the pan is positioned beneath the top sheet, and is coupled to the top sheet, the first lip, and the second lip by at least one weld on an exterior surface of the panel component, wherein the pan is exposed to an interior of the storage tank, and the top sheet is isolated from the interior of the storage tank.

16. The roof panel of claim 15, comprising a panel strip extending from the first lower frame extension to the second lower frame extension, wherein the pan contacts the panel strip.

17. The roof panel of claim 15, wherein the top sheet is welded to the pan around the perimeter of the top sheet.

18. The roof panel of claim 15, wherein the pan comprises a first horizontal section, a vertical section, and a second horizontal section, and wherein a first curved section of the pan extends between the first horizontal section and the vertical section and a second curved section of the pan extends between the vertical section and the second horizontal section.

19. The roof panel of claim 15, wherein the top sheet is seam welded to the pan.

* * * * *